US005847692A

United States Patent [19]

Ono

[11] Patent Number: 5,847,692

[45] Date of Patent: Dec. 8, 1998

[54] COLOR CONVERTING METHOD AND APPARATUS AND IMAGE PROCESSING METHOD AND APPARATUS

[75] Inventor: Kenichiro Ono, Soka, Japan

[73] Assignee: Canon Kabushiki Kaisha, Tokyo, Japan

[21] Appl. No.: 595,167

[22] Filed: Feb. 1, 1996

[30] Foreign Application Priority Data

Feb. 1, 1995 [JP] Japan ..... 7-014978
Jan. 22, 1996 [JP] Japan ..... 8-008171

[51] Int. Cl.[6] ..... G04G 5/04

[52] U.S. Cl. ..... 345/153; 345/199; 358/523

[58] Field of Search ..... 345/153, 150, 345/154, 155, 199; 358/518, 523

[56] References Cited

U.S. PATENT DOCUMENTS 4,233,601 11/1980 Hankins et al. ..... 340/703
5,250,928 10/1993 Kuriki ..... 345/153
5,627,950 5/1997 Stokes ..... 345/518

*Primary Examiner*—Dennis-Doon Chow
*Attorney, Agent, or Firm*—Fitzpatrick, Cella, Harper & Scinto

[57] ABSTRACT

It is an object to provide color converting method and apparatus and a display control apparatus, in which frequencies of colors which are inputted into a lookup table and the contents of the lookup table are changed in accordance with the frequencies of the colors, thereby a color reproducibility is further improved. In a color converting apparatus for converting inputted color information by using a rewritable lookup table (LUT), occurrence frequencies of output color data of the LUT are counted by using a decoder and a counter, and on the basis of the occurrence frequencies of each color which were calculated, an MPU obtains table data which makes a dispersion of the occurrence frequencies of the output color data of the LUT 100 lie within a predetermined range. The resultant table data is written into an address in the LUT.

9 Claims, 13 Drawing Sheets

COLOR CONVERTING METHOD AND APPARATUS AND IMAGE PROCESSING METHOD AND APPARATUS

BACKGROUND OF THE INVENTION

1. Field of the Invention

The invention relates to a color converting method and apparatus for converting inputted color information by using a rewritable lookup table and to a display control apparatus using the color converting apparatus.

2. Related Background Art

A method of converting inputted $2^m$ colors into $2^n$ colors by using a lookup table having a capacity of [$2^m$×n bits (m>n)] is known. For example, assuming that m=$2^6$ and n=4, the lookup table has a memory capacity of $2^6$, namely, 64 words and one word is constructed by four bits. Therefore, 16 colors are selected and outputted for an input of 64 colors.

In case of converting the input colors into the colors of a number smaller than the number of input colors by using the lookup table as mentioned above, when a certain color space is equivalently divided and a color is allocated to each of the divided spaces, for example, so long as a deviation of the input color data is large, there is a case where a delicate color change of the color which is frequently generated is not outputted. For example, assuming that the reddish color is frequently used and the bluish color is not so often used, since the number m of input bits is larger than the number n of output bits, even if data of red colors which are slightly different is inputted, those different red data are outputted as data of the same color. Such a small difference of the input colors is not reflected to the output.

SUMMARY OF THE INVENTION

The invention is made in consideration of the above conventional example and it is an object of the invention to obtain a frequency of a color that is inputted to a lookup table and change the contents of the lookup table in accordance with the frequency, thereby further improving a reproducibility of the color.

Another object of the invention is to make it possible also to cope with a delicate color change.

Still another object of the invention is to enable a display device to preferably reconstruct a target image by converting the target image into a representative color according to the number of colors which can be reconstructed by the display device and a frequency of the color of the target image.

Further another object of the invention is to enable a color conversion table to be generated by the number of colors suitable for the target image.

To accomplish the above object, according to a preferred embodiment of the invention, there is provided a color converting apparatus for converting inputted color information by using a rewritable lookup table, comprising: measuring means for measuring an occurrence frequency of output color data of the lookup table; data obtaining means for obtaining table data which makes a dispersion of the occurrence frequency of the output color data lie within a predetermined range on the basis of the occurrence frequency for every color measured by the measuring means; and writing means for writing the table data obtained by the data obtaining means into the lookup table.

The above and other objects and features of the present invention will become apparent from the following detailed description and the appended claims with reference to the accompanying drawings.

DETAILED DESCRIPTION OF THE PREFERRED EMBODIMENTS

Preferred embodiments of the invention will now be described in detail hereinbelow with reference to the drawings.

<First Embodiment >

Figure 1:
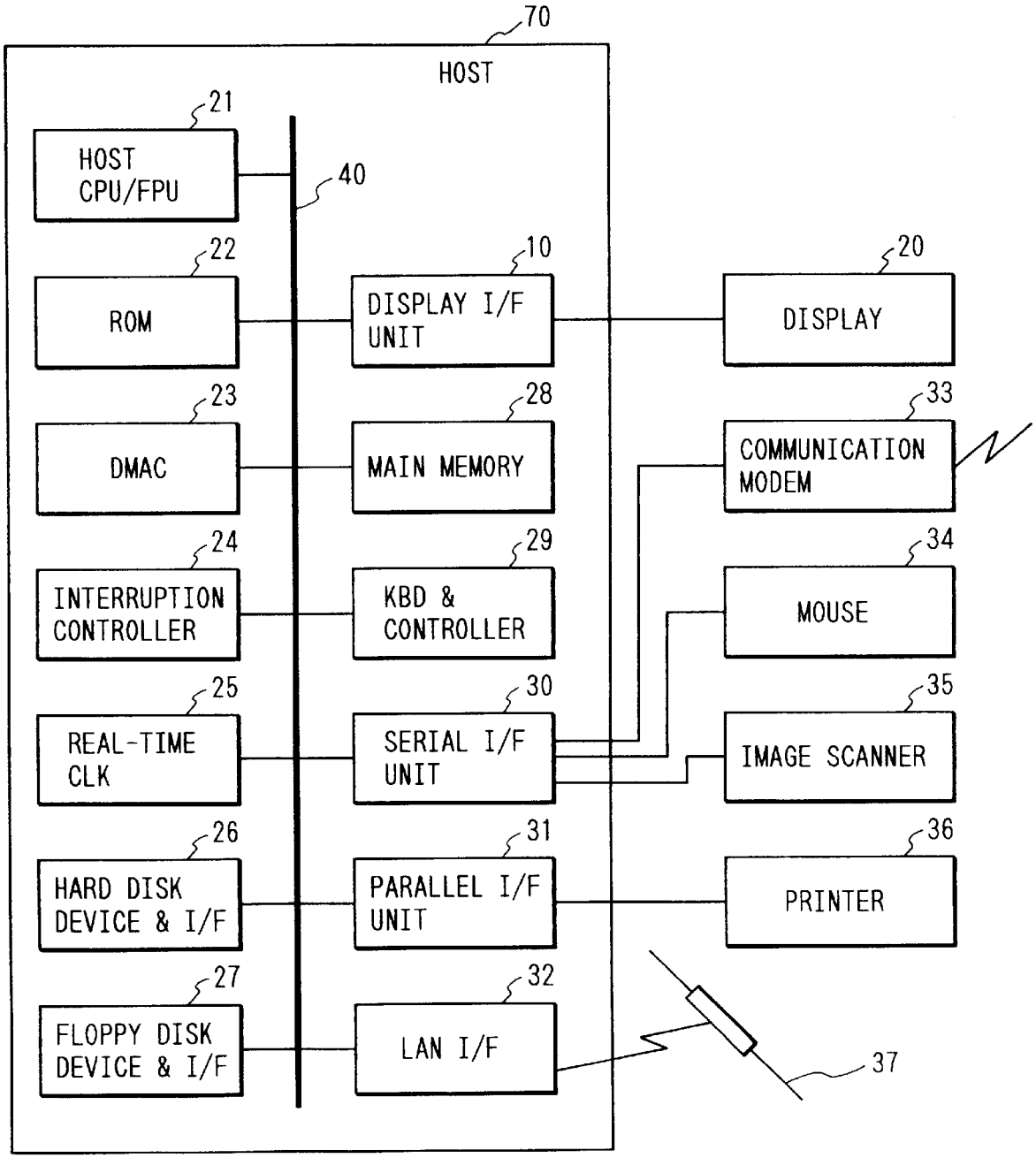
FIG. 1 is a block diagram showing an information processing system using a display device having a display control apparatus according to an embodiment.

FIG. 1 is a block diagram showing a construction of an information processing system including a display device having a display control apparatus and a host computer according to the embodiment.

In the diagram, reference numeral 10 denotes a display interface unit of the display control apparatus of the embodiment, and 20 indicates a display to display various data, messages, etc. by a control of the display I/F unit 10. The display I/F unit 10 also has a display memory window area which can be accessed by a host CPU 21. The host CPU 21 controls the whole information processing system of the embodiment in accordance with programs or the like stored in an ROM 22. Reference numeral 22 denotes the ROM in which the programs to be executed by the host CPU 21 have been stored, and 23 indicates a DMA controller (direct memory access controller; hereinafter, simply referred to as a DMAC) which can directly perform a data transfer between a main memory 28 and each constituent unit of the information processing system without passing through the host CPU 21.

Reference numeral 24 denotes an interruption controller for controlling an interrupting process at the time of the execution of the program by the host CPU 21; 25 a real-time clock having a time measuring function in the information processing system of the embodiment; 26 a hard disk device & interface as an external memory device; 27 a floppy disk device & interface as an external memory device; and 28 the main memory which is used as a work area or the like when the host CPU 21 executes the program.

Reference numeral 29 denotes a keyboard & controller for inputting character information such as various characters or the like, control information, or the like; 30 a serial interface unit for interfacing with each constituent unit, which will be explained hereinlater; 31 a parallel interface unit for performing a signal connection between a printer 36 and the information processing system of the embodiment; and 32 an LAN (local area network) interface for interfacing between an LAN 37 such as an Ethernet (by XEROX Co., Ltd.) or the like and the information processing system.

Reference numeral 33 denotes a communication modem for performing a signal modulation between a communication line and the information processing system; 34 a mouse as a pointing device; and 35 an image scanner to read an original image or the like. The component elements 33 to 35 execute transmission and reception of signals to/from the information processing system through the serial I/F 30. The printer 36 is, for example, an ink jet printer, a laser beam printer, or the like which can record at a relatively high resolution. Reference numeral 40 denotes a system bus including a data bus, a control bus, an address bus, and the like for connecting each of the above units and each of the above component elements.

In the information processing system having the above construction, the user of the system operates in correspondence to various information displayed on a display screen of the display 20. Namely, character/image information or the like that is supplied from an external apparatus, hard disk 26, floppy disk 27, scanner 35, keyboard 29, and mouse 34 which are connected to the LAN 37 or the like is displayed on the display screen of the display 20. Further, operation information or the like that is concerned with the system operation of the user and has been stored in the main memory 28 is also displayed on the display screen of the display 20. The user executes an instructing operation for an editing system of the information while looking at the display contents. The above various units and component elements or the like supply display information to the display 20.

Figure 2:
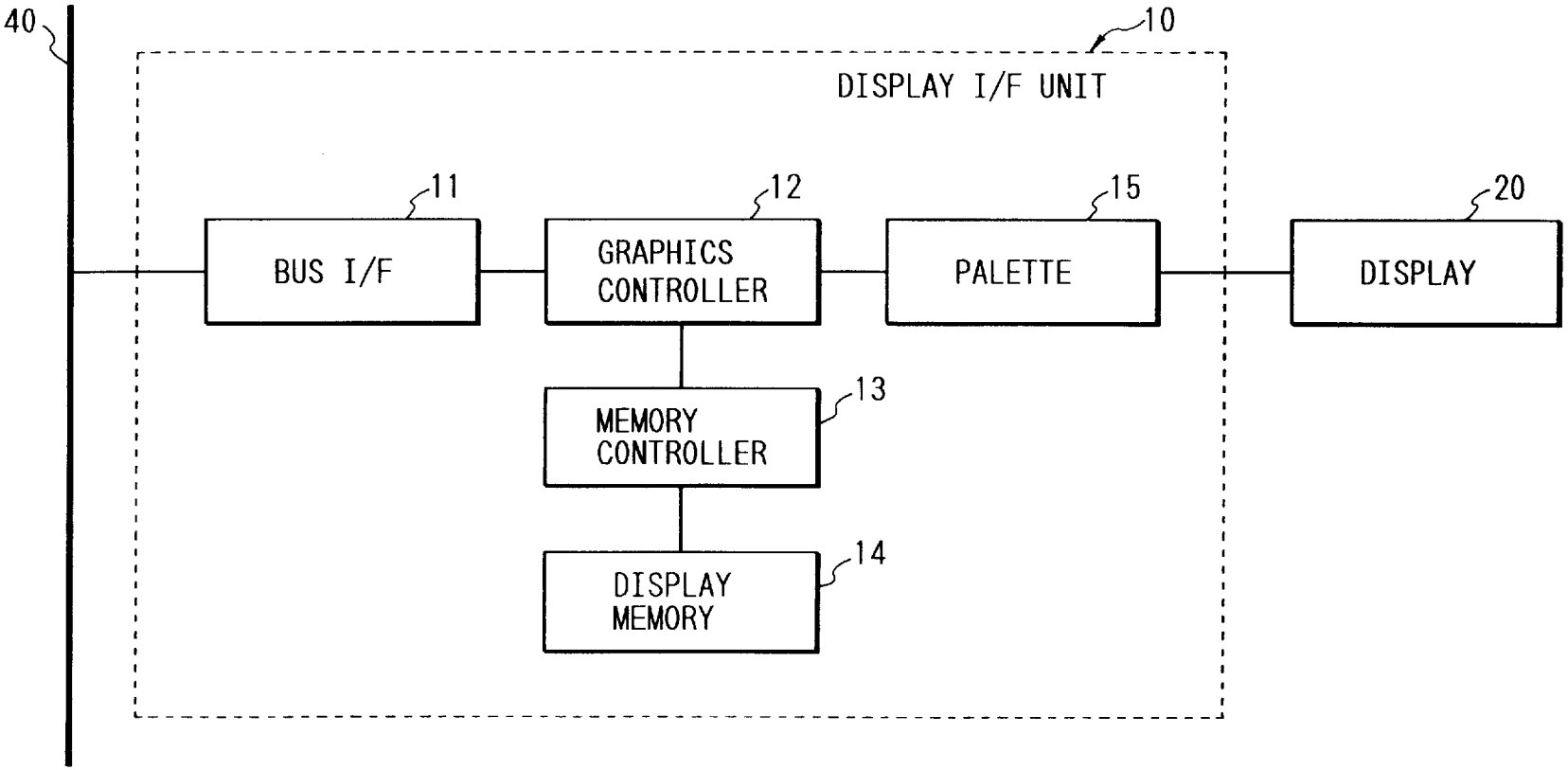
FIG. 2 is a block diagram showing the details of a display interface unit in the embodiment.

FIG. 2 is a block diagram showing the details of the display I/F unit 10 of the embodiment.

A bus interface (I/F) 11 controls the signal interface between the system bus 40 and the display I/F unit 10 and also controls the interface of data, address, and control signal from the system bus 40. Reference numeral 12 denotes a graphics controller for receiving a display command from the host CPU 21 through the bus I/F 11, interpreting it, writing the display contents into a display memory 14 through a memory controller 13, and reading out data from the display memory 14, thereby controlling the display contents to be displayed on the display 20. The display data to be displayed on the display 20 under the control of the memory controller 13 has been stored in the display memory 14. Reference numeral 15 denotes a palette for color converting color data from the graphics controller 12 and outputting to the display 20 when a color image is displayed on the display 20. It is now assumed that the display 20 uses a digital input device for directly inputting a digital data output from the palette 15. For example, a display (FLCD) using a ferroelectric liquid crystal display device or the like can be used.

Figure 3:
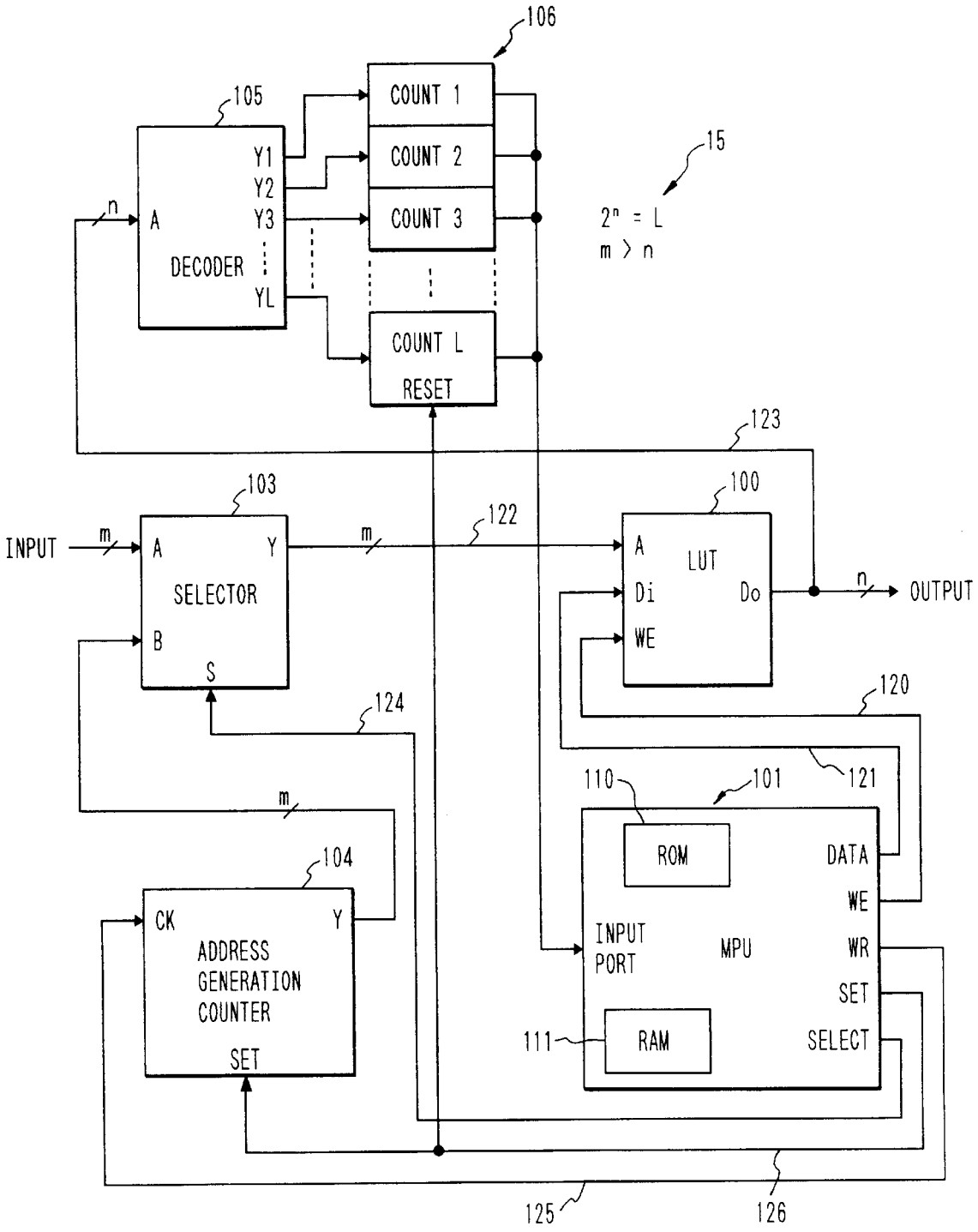
FIG. 3 is a block diagram showing a construction of a palette in the embodiment.

FIG. 3 is a block diagram showing a construction of the palette 15 in the embodiment.

A lookup table (LUT) 100 has the same function as an SRAM (static RAM) and is constructed by [m words×n bits]. Data can be written into the LUT 100 when a write enable (WE) signal 120 to a WE (write enable) terminal is at the high level. Therefore, when an address signal 122 is inputted to an A (address) terminal, an MPU 101 generates data (DATA) 121 to a Di (data input) terminal and sets the WE signal 120 to the high level, thereby enabling arbitrary data to be stored into an arbitrary address in the LUT 100. When the WE signal 120 is at the low level, the LUT 100 outputs data (n bits) 123 in the address stored in the LUT 100 from a Do (data output) terminal to the display 20 in accordance with the address designated by the address (A) input signal 122.

The MPU 101 has a data bus (DATA), an input port (INPUT PORT), and an output port. Among them, a signal from the output port is used for the WE signal 120 of the LUT 100, an S (selection) signal 124 of a selector 103, a clock (CK) signal 125 of an address generation counter 104, a setting (SET) signal, and a resetting (RESET) signal 126 of a counter 106. The MPU 101 has an ROM 110 to store control programs and various data, an RAM 111 which is used as a work area of the MPU 101 and temporarily preserves various data, and the like.

The selector 103 selects an A input when the selection signal 124 which is inputted to a selecting terminal (S) is at the low level. The selector 103 selects a B input when the selection signal 124 is at the high level. The A input of the selector 103 is connected to an output of the graphics controller 12, and the B input is connected to an m-bit output of the address generation counter 104. The address generation counter 104 is an m-bit counter such that when the pulse signal 126 at the high level is inputted to a setting (SET) terminal, the address generation counter 104 sets all of output bits to the high level, and when the clock (write) signal 125 is inputted to a clock (CK) terminal after that, all of the output bits are set to the low level in response to a leading edge of the clock signal 125, and each time the clock (CK) signal 125 is inputted, a count value is sequentially increased one by one.

Reference numeral 105 denotes a decoder for inputting the output data (n bits) 123 from the LUT 100 and decoding into $2^n$ (=L) signals. Reference numeral 106 denotes a counter having L counters (1 to L). Each signal decoded by the decoder 105 is inputted to each of the L counters and the signals decoded by the decoder 105 are counted by the counter 106. When the pulse signal 125 at the high level is inputted to a resetting (RESET) terminal, all of the L counters are reset.

Figure 4:
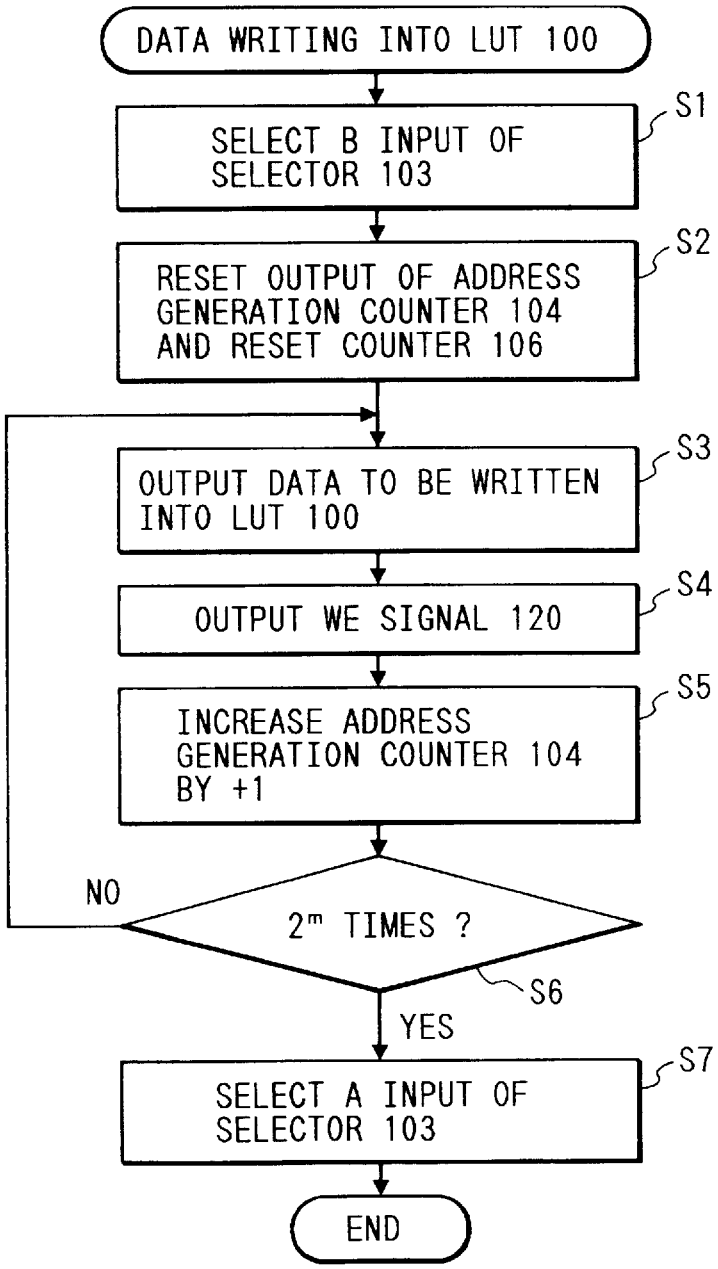
FIG. 4 is a flowchart showing an updating process of LUT data according to an MPU of the palette in the embodiment.

FIG. 4 is a flowchart showing a data writing process to the LUT 100 which is executed by the MPU 101 in the embodiment. A control program to execute this process has been stored in the ROM 110.

First in step S1, the MPU 101 sets the selection signal 124 to the high level and sets the WE signal 120, clock signal 125, and pulse signal 126 to the low level. Thus, the selector 103 selects the B input as an output of the address generation counter 104 and supplies into the LUT 100. In step S2, the MPU 101 outputs the pulse signal 126 to the SET terminal of the address generation counter 104. By changing the output signal from the output port (SET) to the low level (L) →high level (H)→(L), the pulse signal 126 at the high level is outputted. Thus, all of the L counters of the counter 106 are also simultaneously reset. By subsequently changing the clock signal 125 that is outputted from a WR terminal to L→H→L and outputting the pulse signal at the high level, the output of the address generation counter 104 is set to "0". The output of the address generation counter 104 passes through the selector 103 and is inputted to the address input (A) terminal of the LUT 100.

The processing routine advances to step S3 and the data (DATA) 121 to be written into the LUT 100 is outputted. In step S4, the WE signal 120 is changed to L→H→L and the data is written into the address "0" in the LUT 100. After completion of the data writing into one address, the WE signal 120 is set to the low level. In step S5, the clock signal 125 is outputted and the count value of the address generation counter 104 is increased by +1.

In step S6, a check is made to see whether or not such a writing operation has been performed the number of times corresponding to all of the addresses in the LUT 100, namely, $2^m$ times or not. If NO, the processing routine is returned to step S3 and the operations in steps S3 to S5 are repeated. Desired data is sequentially written into the addresses which are designated by the output of the address generation counter 104. After the data has been written into all of the addresses in the LUT 100, the processing routine advances to step S7. The selection signal 124 of the selector 103 is set to the low level, so that the selector 103 selects the display data which is inputted to the A terminal and outputs to the LUT 100.

Thus, when the m-bit data is inputted from the graphics controller 12, the m-bit data passes through the selector 103 and is inputted to the address input terminal of the LUT 100. Data of n bits corresponding to the m-bit data is generated from the LUT 100. At the same time, the decoder 105 decodes the n-bit data. For example, when the value of the n-bit data is equal to "3", the signal is outputted to an output terminal Y3 of the decoder 105. The third counter 3 in the counter 106 is counted up. In a manner similar to the above, when the m-bit data is inputted from the graphics controller 12, the corresponding counter in the counter 106 is counted up in accordance with the value of the m-bit data.

Processes such that the count result of each counter in the counter 106 is subsequently inputted and the MPU 101 forms data to be written into the LUT 100 will now be described with reference to a flowchart of FIG. 5.

Figure 5:
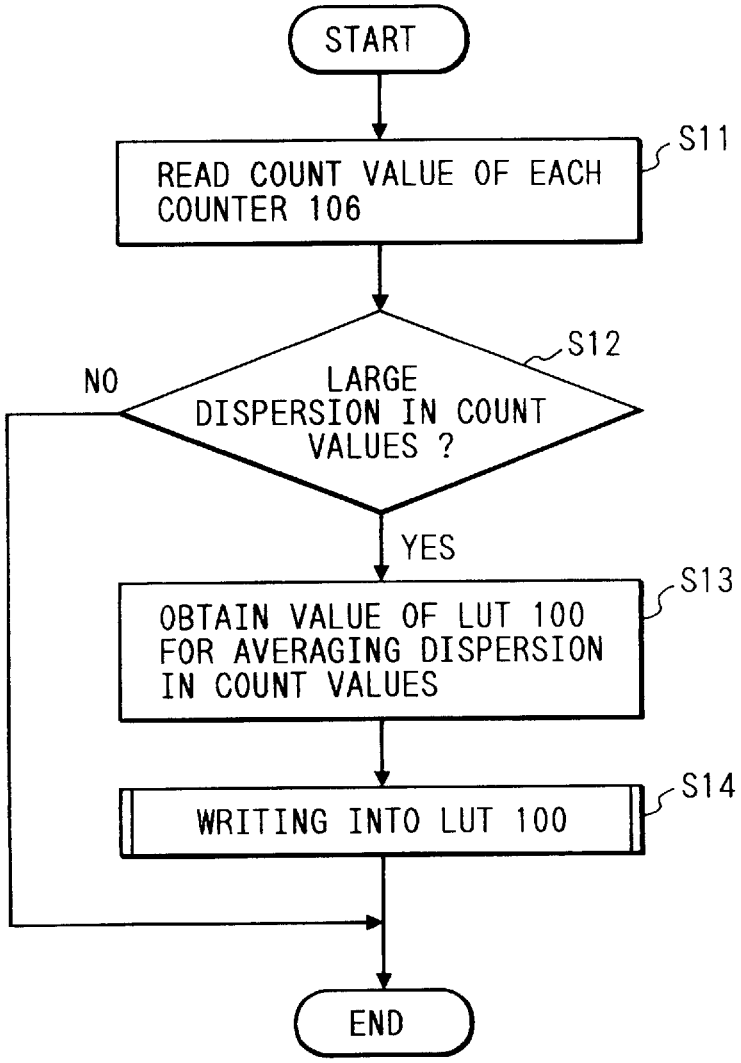
FIG. 5 is a flowchart showing a process to decide updating data in the LUT on the basis of a count value of a counter in the palette in the embodiment.

FIG. 5 is the flowchart showing the processes of the MPU 101 for reading the count value of each counter in the counter 106 and obtaining the data to update the LUT 100. This processing routine is activated when the display of one picture plane is finished or each time a proper number of lines are displayed.

First in step S11, the MPU 101 sequentially reads out the count values of the counters in the counter 106 from an input port terminal at proper timings. In step S12, a check is made to see if there is a dispersion in each of the read-out count values. If NO, the counter 106 is reset by the signal 126 and the processing routine is finished.

When there is a dispersion in step S12, the processing routine advances to step S13 and there is calculated a table value of the LUT 100 such as to reduce the dispersion by narrowing an input range of the input value of the LUT 100 corresponding to the color in which a using frequency is high or by widening the input range of the input value of the LUT 100 corresponding to the color in which the using frequency is low. Step S14 follows and the table value in the LUT 100 is updated in accordance with the flowchart of FIG. 4 mentioned above.

A sequence for averaging the count values in step S13 in FIG. 5 will now be described with reference to FIGS. 6 and 7.

It is now assumed that the number of bits of the data that is outputted from the LUT 100 is equal to n.

(1) The whole use output frequency is counted.

(2) $2^n/4$ output values are selected from the value of a large output frequency and $2^n/4$ output values are selected from the value of a small output frequency.

(3) A range of a threshold value of an input range is changed. In this instance, although all of the ranges have been set to every $2^m/2^n$ at the initial value, a range of $2^n/4$ output values from the value of a large frequency is held to $2^m/(2\times2^n)$, a range of $2^n/4$ output values from the value of a small frequency is held to $(3\times2^m)/(2\times2^n)$, and the other ranges are held to $2^m/2^n$.

Figure 6:
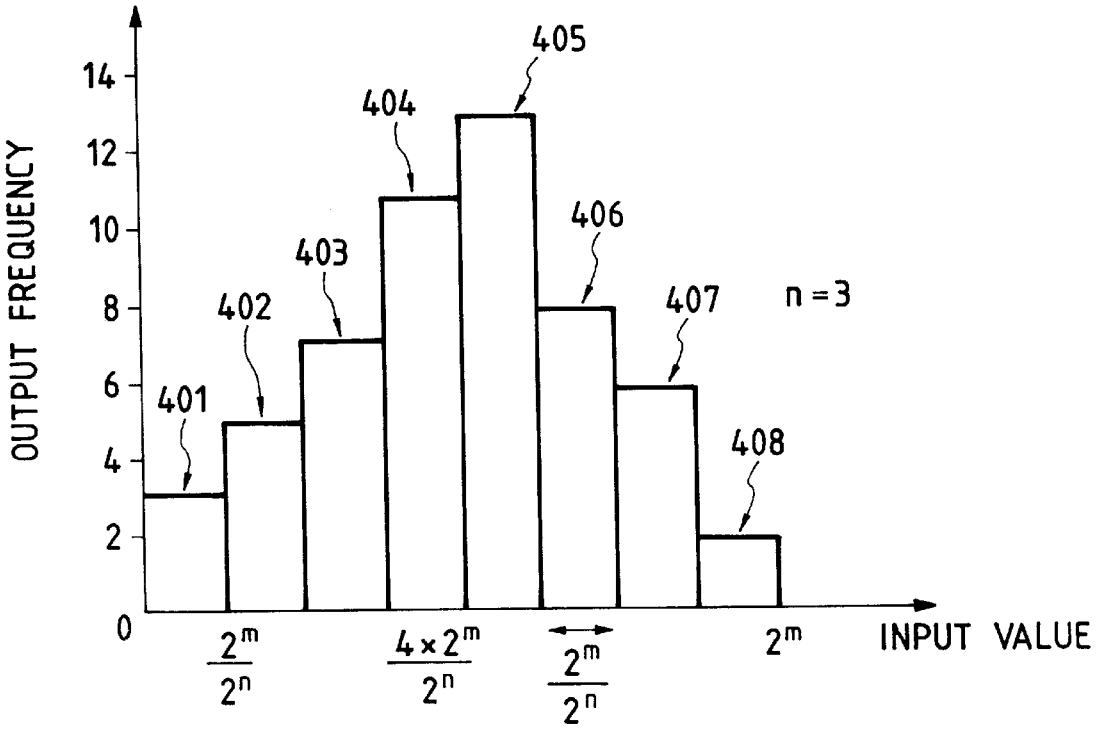
FIG. 6 is a diagram showing an example of the relation between the input values when n=3 and the output frequencies.

FIG. 6 is a diagram showing an example of the relation between the input values when n=3 and the output frequencies. The number of input bits is set to m and the number of output bits is set to n. In FIG. 6, therefore, a width of one vertical rod is equal to $2^m/2^n$.

In FIG. 6, the frequencies shown at 405 and 404 lie within a range of $\{(2^n=8)/4 =\}2$ values from the large output frequency. The frequencies shown at 401 and 408 lie within a range of $(2^n/4=)$ 2 values from the value of small frequencies shown at 401 and 408.

Therefore, the rule of the above item (3) is applied and the ranges shown at 404 and 405 are changed to a width of $[2^m/(2\times2^n)]$. The ranges shown at 401 and 408 are extended to $\{(3\times2^m)/(2\times2^n)\}$.

Figure 7:
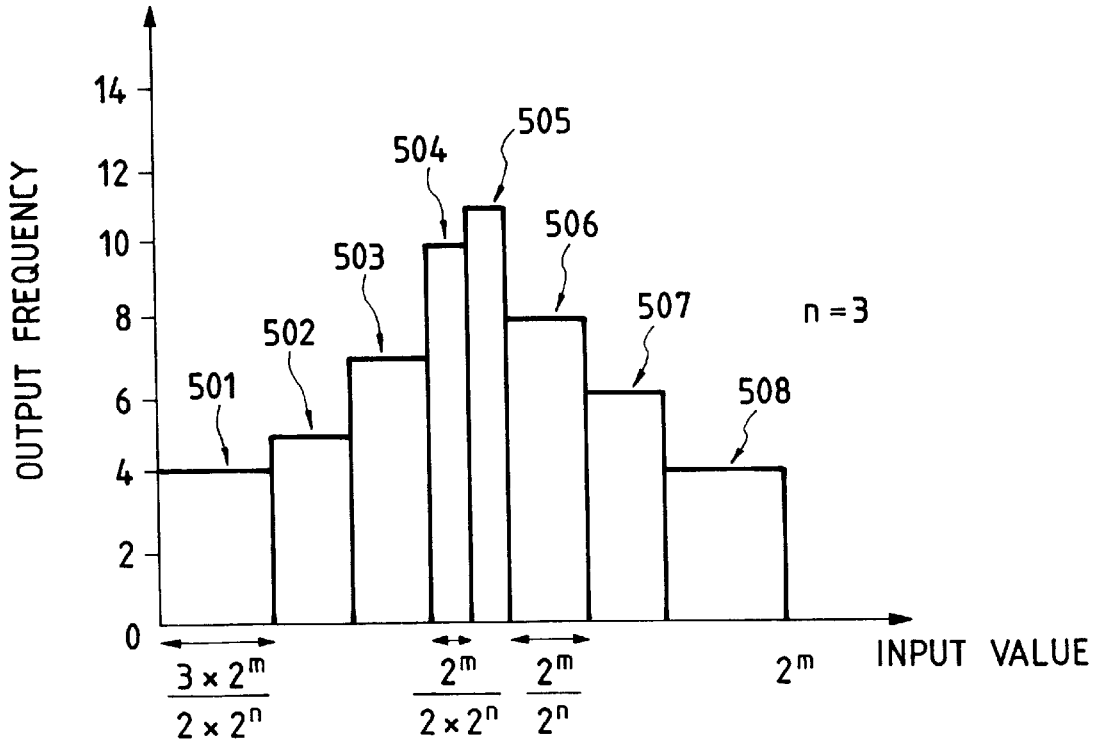
FIG. 7 is a diagram showing the relation between the input values after completion of the updating of the LUT data and the output frequencies.

FIG. 7 shows those ranges.

Therefore, although the maximum value of the frequencies is equal to "13" and the minimum value is equal to "2" in FIG. 6, the maximum value of the frequencies is equal to "11" and the minimum value is equal to "4" in FIG. 7. From the relation between the input data and the output data (display colors) of the LUT 100, it will be understood that the color change in the input data is more reflected to the output color.

As mentioned above, in the embodiment, the inputted color information is converted by using the rewritable lookup table, the occurrence frequencies of the output color data of the lookup table are measured, and the table data which makes the dispersion of the occurrence frequencies of the output color data lie within the predetermined range is obtained on the basis of the occurrence frequency for every color which was measured. An operation is performed so as to write the table data obtained into the lookup table.

The timing at which the processes shown in the flowchart of FIG. 5 mentioned above is set to a timing that is equal to or larger than at least a few lines of the display data, so that a precision of the data to be stored in the LUT 100 can be raised.

<EXAMPLE 1 >

For example, the MPU 101 reads out each of the total values of the counter 106 every three lines of the display data. In this instance, assuming that the number of pixels which are displayed to one line of the display 20 is equal to 640, (the number of bits of each counter of the counter 106)=$\{(\log640\times3)/\log2\}\cong10.9$The number of necessary bits of each counter of the counter 106 is equal to "11". In this case, the count value of each counter of the counter 106 is reset every three lines and every VSYNC.

<EXAMPLE 2 >

The MPU 101 resets each counter of the counter 106 every VSYNC and reads out the count value of each counter every picture plane. The data of the LUT 100 is determined on the basis of the display data in which one picture plane is averaged.

Assuming that the number of pixels per line is set to 640 and the number of lines per picture planes is set to 400, when the number of bits of each counter of the counter 106 is equal to x, $$2^x=640\times400$$

$$x=(log640\times400)/log2\cong17.9$$

Therefore, the number x of necessary bits of each counter of the counter 106 is equal to "18".

<Second Embodiment >

The second embodiment of the invention will now be described.

The second embodiment is made in consideration of that when the display data is sampled every picture plane in a manner similar to, for example, <Example 2> mentioned above, the count value of 18 bits of each counter of the counter 106 is needed.

Figure 8:
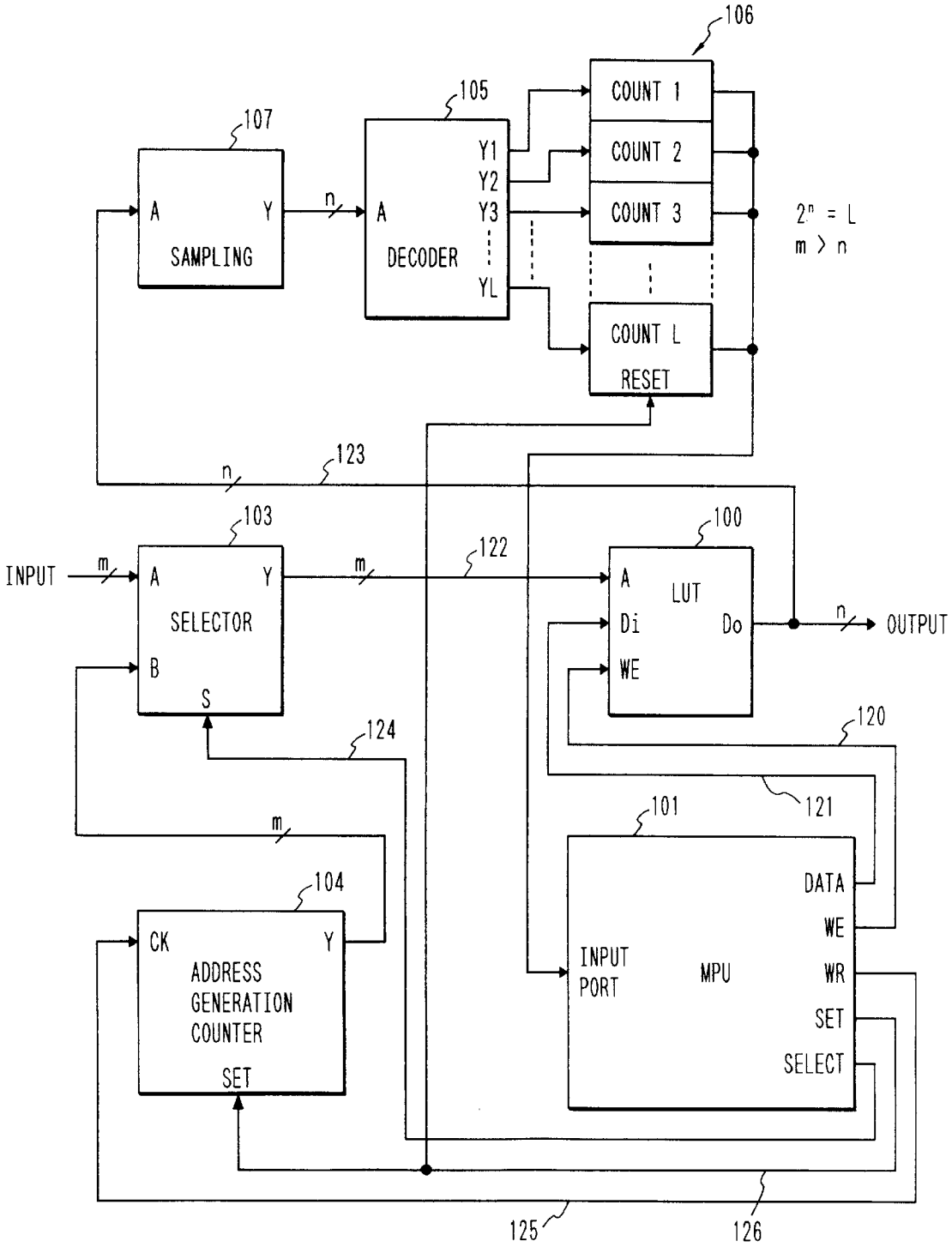
FIG. 8 is a block diagram showing a construction of a palette according to the second embodiment of the invention.

FIG. 8 is a block diagram showing a construction of the palette 15 according to the second embodiment of the invention and portions common to those in the above embodiment are designated by the same reference numerals and their descriptions are omitted here.

As shown in FIG. 8, a sampling circuit 107 is provided before the decoder 105 and, for example, a case of sampling the display data once for every ten pixels of the input data will now be considered. In this case, the number x of bits of each counter of the counter 106 is $$x=(log640\times400\div10)/log2\cong14.6$$

Therefore, the number of bits is equal to "15". By setting as mentioned above, the number of bits of each counter of the counter 106 can be reduced.

Generally, even if the display data is sampled by thinning out the input data as mentioned above, it is considered that there is not so large difference between the output frequencies. Therefore, such a circuit is effective to reduce the circuit scale.

<Third Embodiment >

Figure 9:
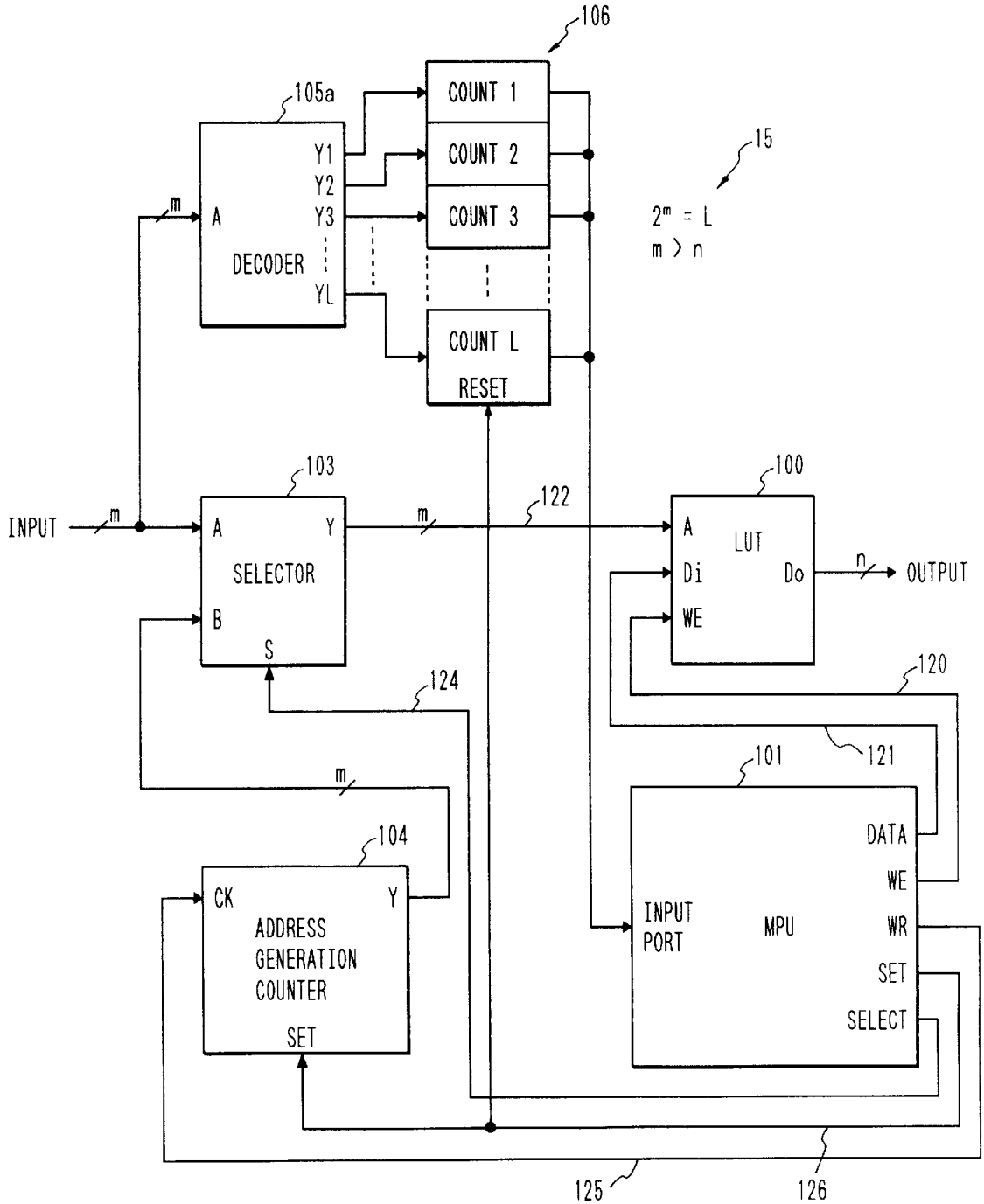
FIG. 9 is a block diagram showing a construction of a palette according to the third embodiment of the invention.

In the third embodiment, the number of bits of an input of a decoder 105*a* shown in FIG. 9 is set to the same number (m) as that of the input data and a dispersion of the color designation in the input data is examined. When there is a large dispersion in the frequency of the output data from the LUT 100, since the MPU 101 can rewrite the contents of the LUT 100 on the basis of the input data, a data precision of the LUT 100 is improved.

FIG. 9 is a block diagram showing a circuit construction of the palette 15 according to the third embodiment. Portions which are common to those in the above drawings are designated by the same reference numerals and their descriptions are omitted.

The operation of the circuit is fundamentally similar to that in case of the first embodiment. The third embodiment differs from the foregoing embodiment with respect to a point that the input data from the graphics controller 12 is directly decoded. The MPU 101 classifies the count values read out from the counters of the counter 106 and examines whether there is a large dispersion in the count values of the counters of the counter 106 or not. If NO, the data updating process of the LUT 100 is not performed. When there is a large dispersion, the MPU 101 calculates a table value of the LUT 100 with reference to the count value of each counter of the counter 106 and updates the table value of the LUT 100 so as to reduce the whole dispersion in a manner such that the color in which the using frequency of the display data is high decreases and that the color in which the using frequency is low increases.

<Fourth Embodiment >

Figure 10:
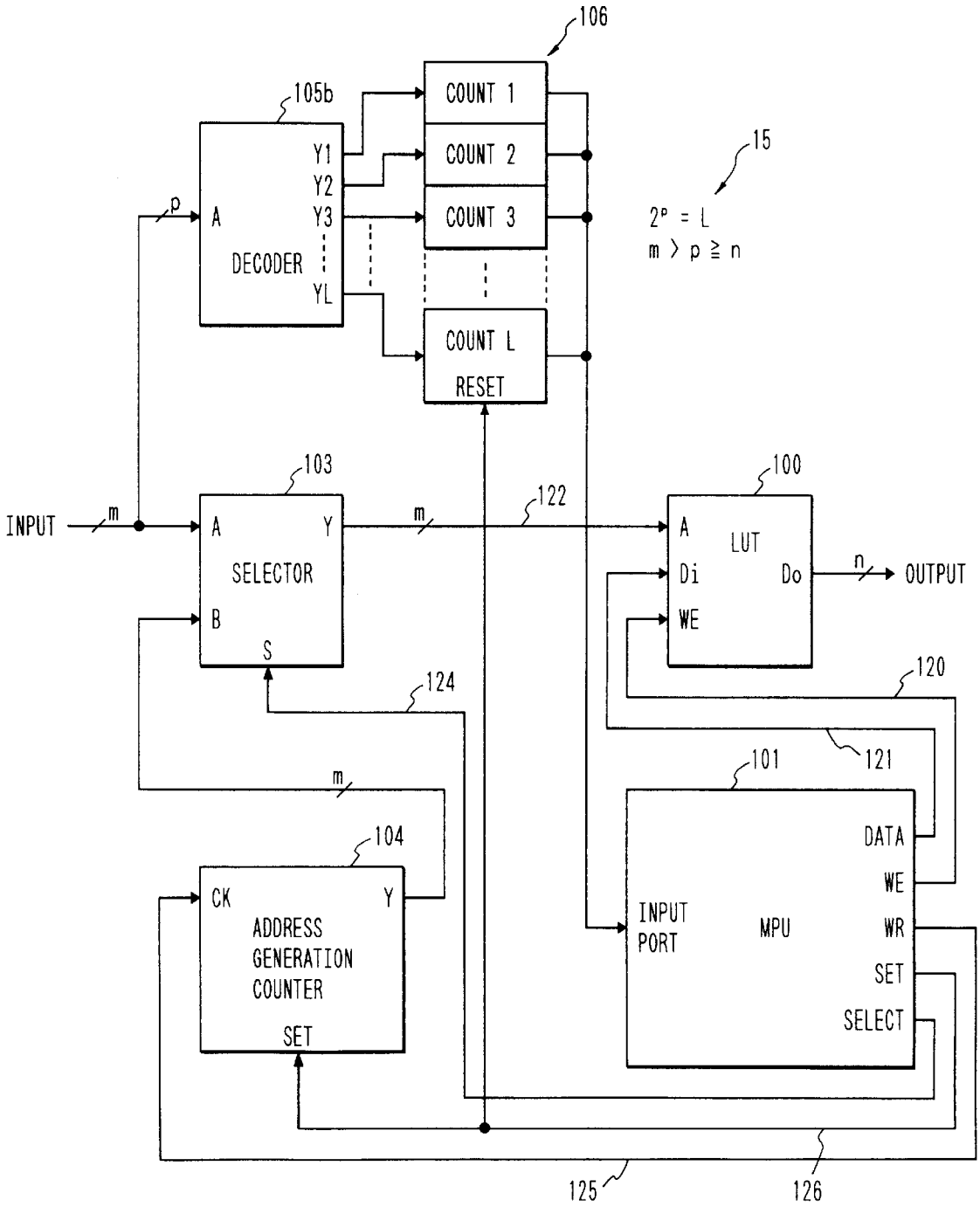
FIG. 10 is a block diagram showing a construction of a palette according to the third embodiment of the invention.

As shown in FIG. 10, it is an object of the fourth embodiment to reduce the number of counters of the counter 106 by setting the input of a decoder 105*b* to p bits ($m>p\geq n$) and by setting the number of input bits to a value smaller than m. It is considered that even when the number of counters of the counter 106 is reduced as mentioned above, the inherent object can be sufficiently accomplished although the precision merely slightly deteriorates. For example, assuming that m=6 and p=5 and n=4, $L=2^5=32$. Since the output is selected from 16 ($=2^4$) colors, however, $32/16=2$ and it is sufficient to prepare two counters as an average for the same output value.

FIG. 10 shows a circuit construction of the palette 15 in the fourth embodiment and portions common to those in the forgoing drawings are designated by the same reference numerals and their descriptions are omitted.

Although each embodiment has been solely described above, the invention is not limited to them. A circuit construction of a better efficiency can be also realized by combining some of the above embodiments. For example, by combining the second and fourth embodiments mentioned above, the number of bits of each counter of the counter 106 can be reduced and the hardware can be further decreased.

On the other hand, the frequency of the color that is inputted to the lookup table is obtained, the contents of the lookup table are changed in accordance with it, and a color reproducibility can be further improved.

Moreover, the optimum color can be also outputted in correspondence to a delicate color change.

That is, the color difference in the output data can be reflected by the output data at a high fidelity.

An increase in circuit scale is suppressed and the color difference in the input data can be reflected to the output data.

<Fifth Embodiment >

Figure 11:
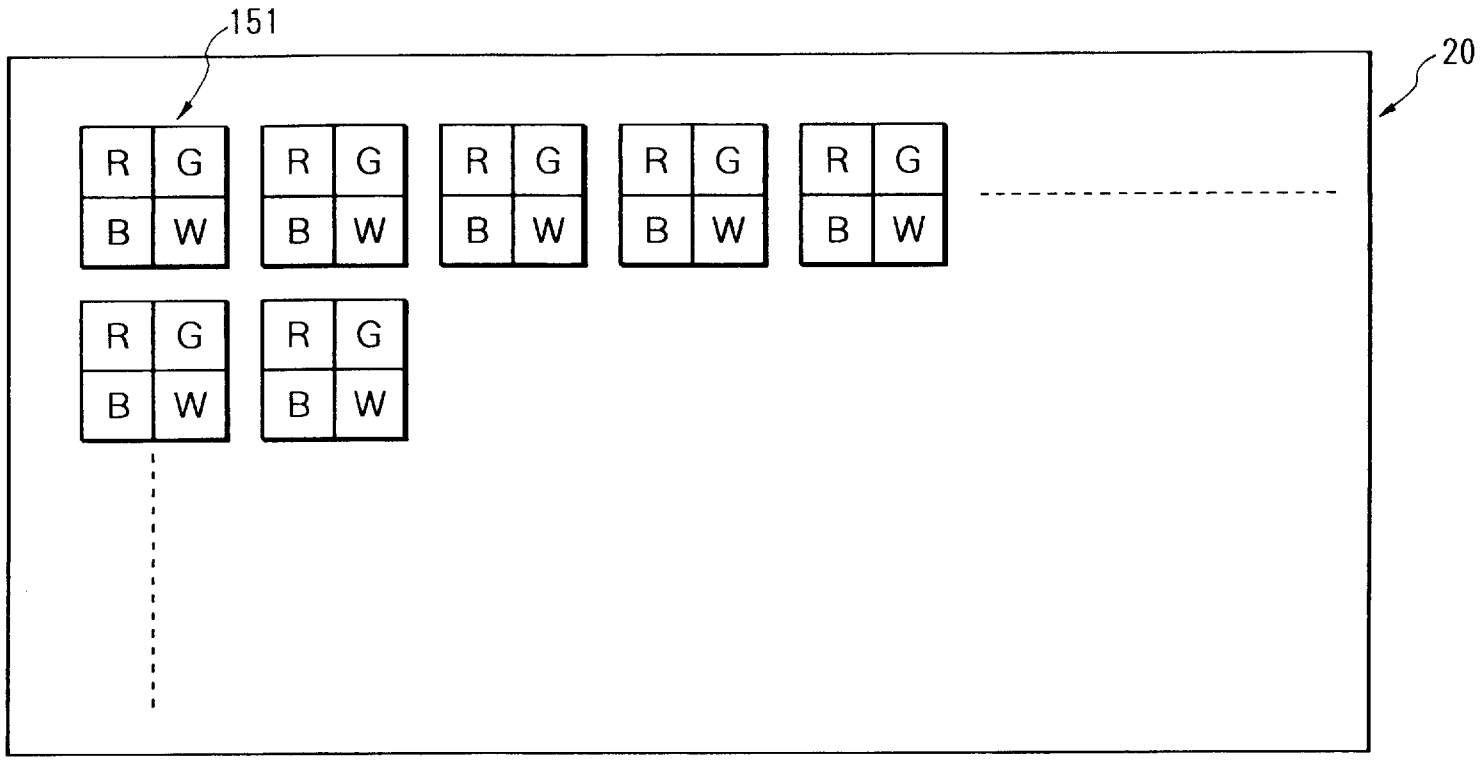
FIG. 11 is a diagram showing an example of a construction of a display device.

An example in the case where the display 20 has a construction as shown in FIG. 11 will now be described.

FIG. 11 will be first described.

It is now assumed that the display 20 is a liquid crystal display and each pixel 151 is constructed by four cells of red (hereinafter, abbreviated to R), green (hereinafter, abbreviated to G), red (hereinafter, abbreviated to B), and luminance (hereinafter, abbreviated to W) and each cell has a state of two values indicative of the light-on and light-off. Thus, each pixel can show states of 16 values.

When the display 20 has the construction as mentioned above, the display will now be described with reference to FIGS. 2 and 3.

It is assumed that the graphics controller 12 generates data of total 18 bits (6 bits for each color of R, G, and B) to the palette 15. As shown in FIG. 3, the palette 15 is further divided and an output of the graphics controller 12 is inputted to the input A of the selector 103 and it is now assumed that m=18.

An output of the LUT 100 is set to n=4.

{in this instance, the operation of the palette 15 is as described in <First embodiment>}

Namely, the input of the LUT 100 is set to m =18 and 16 kinds of outputs are selected from among $2^{18}$ ($\cong$260,000) kinds of outputs so as to reduce the dispersion of the using frequency.

<Sixth Embodiment >

It is now assumed that the display 20 has the construction as shown in FIG. 11 described in <Fifth embodiment> and, for example, the number of display input pixels to the palette 15 is set to 640 in the lateral direction and the display 20 can display 1280 pixels in the lateral direction, two pixels can correspond to one pixel of the input. Therefore, when considering two pixels as one unit, there are three kinds of states per color: namely, a state in which two cells are lit on; a state in which one cell is lit on; and a state in which no cell is lit on. Therefore, in case of four colors, $3^4$ (=81) kinds of states can be shown.

The display when the display 20 has the construction as mentioned above will now be described with reference to FIGS. 2 and 3.

It is now assumed that the graphics controller 12 generates the data of total 18 bits (6 bits for each color of R, G, and B) to the palette 15. The palette 15 is further divided as shown in FIG. 3. It is assumed that the output of the graphics controller 12 is inputted to the input A of the selector 103 and, in this instance, m=18.

In the display 20, since two pixels are made correspond to one pixel, the output of the LUT 100 is set to n=8.

{in this instance, the operation of the palette 15 is as described in <First embodiment>}

Namely, the input of the LUT 100 is set to m=18 and 81 kinds of outputs are selected from among $2^{18}$ (=260,000) kinds of outputs so as to reduce the dispersion of the using frequency.

<Seventh Embodiment >

Figure 12:
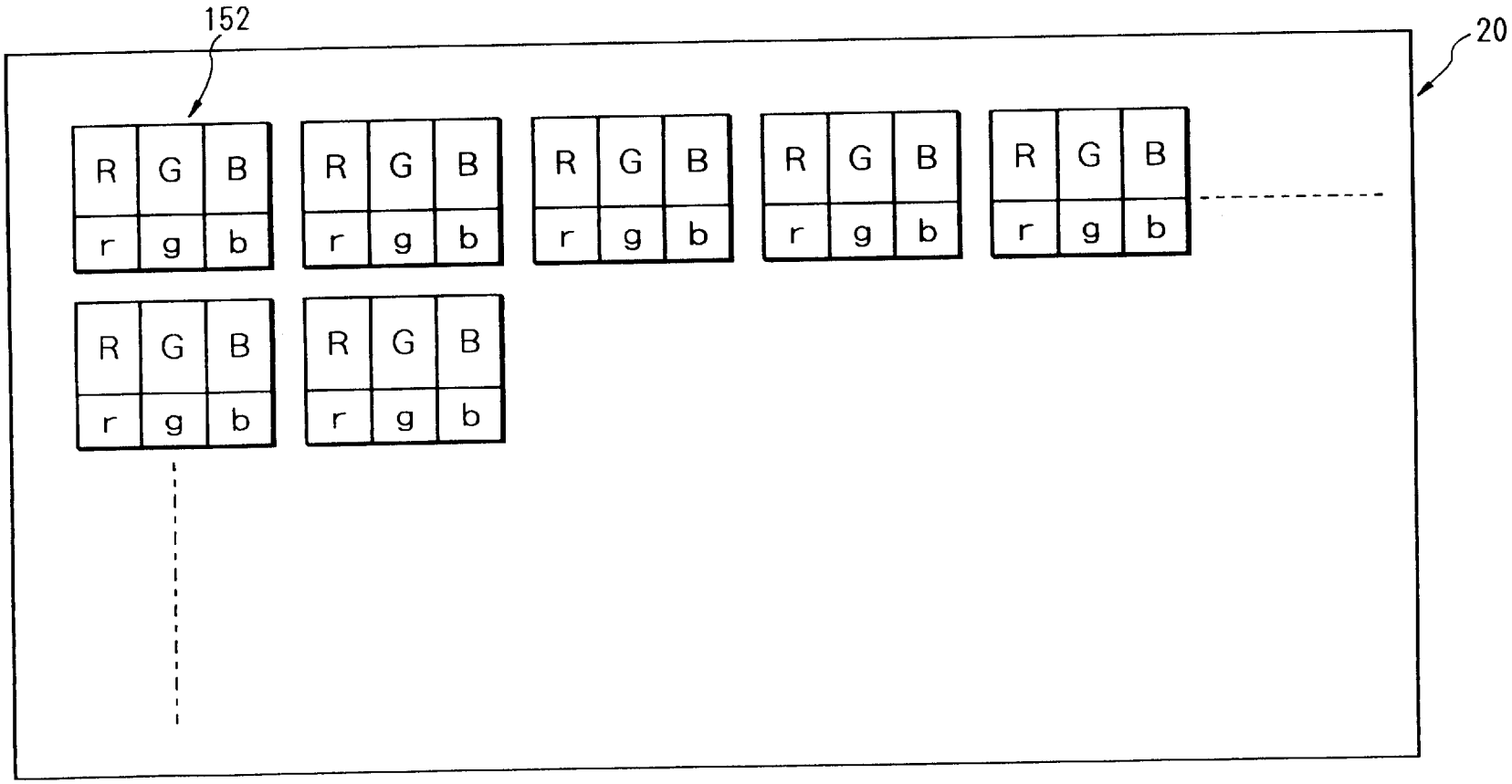
FIG. 12 is a diagram showing an example of a construction of a display device.

An example in which the display 20 has a construction as shown in FIG. 12 will now be described.

FIG. 12 will be first explained.

It is now assumed that the display 20 is a liquid crystal display and each pixel 152 is constructed by total six cells of an area ratio 2 of red (hereinafter, abbreviated to R), an area ratio 1 of red (hereinafter abbreviated to r), an area ratio 2 of green (hereinafter, abbreviated to G), an area ratio 1 of green (hereinafter, abbreviated to g), an area ratio 2 of blue (hereinafter, abbreviated to B), and an area ratio 1 of blue (hereinafter, abbreviated to b) and each cell has states of two values indicative of light-on and light-off. Each color has four kinds of states:

namely, a light-on state of an area ratio 3 (for example, R and r are lit on); a state of the area ratio 2 (R is lit on); a state of the area ratio 1 (r is lit on); and a state in which nothing is lit on. Therefore, $4^3$ (=64) kinds of states can be shown by three colors.

The display when the display 20 has the construction as mentioned above will now be described with reference to FIGS. 2 and 3.

It is assumed that the graphics controller 12 generates the data of total 18 bits (6 bits for each color of R, G, and B) per pixel to the palette 15. The palette 15 is further divided as shown in FIG. 3 and the output of the graphics controller 12 is inputted to the input A of the selector 103 and, in this instance, m=18.

The output of the LUT 100 is set to n=6.

At this time, the operation of the palette 15 is as described in <First embodiment>.

Namely, the input of the LUT 100 is set to m=18 and 64 kinds of outputs are selected from among $2^{18}$ (≅260,000) kinds of outputs so as to reduce the dispersion of the using frequency.

<Eight Embodiment >

It is now assumed that the display 20 has the construction as shown in FIG. 12 described in <Seventh embodiment> and, for example, the number of display input pixels to the palette 15 is equal to 640 in the lateral direction and the display 20 is constructed by 1280 pixels in the lateral direction. Since two pixels can correspond to one input pixel, there are the following seven kinds of states per color.

(1) Light-on state of an area ratio 6 (for example, R, r, R, r are lit on)

(2) Light-on state of an area ratio 5 (for example, R, r, R are lit on)

(3) Light-on state of an area ratio 4 (for example, R, R are lit on)

(4) Light-on state of the area ratio 3 (for example, R, r are lit on)

(5) Light-on state of the area ratio 2 (for example, R is lit on)

(6) Light-on state of the area ratio 1 (for example, r is lit on)

(7) Nothing is lit on. Therefore, $7^3$ (=343) kinds of states can be shown by three colors.

The display when the display 20 has the construction as mentioned above will now be described with reference to FIGS. 2 and 3.

It is assumed that the graphics controller 12 generates data of total 18 bits (6 bits for each color of R, G, and B) per pixel to the palette 15. The palette 15 is further divided as shown in FIG. 3. The output of the graphics controller 12 is inputted to the input A of the selector 103. At this time, m=18.

Since the output of the LUT 100 corresponds to an amount of two pixels, n=12.

At this time, the operation of the palette 15 is as described in <First embodiment>.

Namely, the input of the LUT 100 is set to m=18and 343 kinds of outputs are selected from among $2^{18}$ (≅260,000) kinds of outputs so as to reduce the dispersion of the using frequencies.

<Ninth Embodiment >

A generating process of an LUT in a system in which a display A 71 and a display B 72 are connected to a host computer 70 shown in FIG. 1 will now be described hereinbelow.

As shown in FIGS. 11 and 12, there is a possibility such that the number of colors which can be displayed and display colors differ every display.

Therefore, the display interface generates the LUT 100 in accordance with the number (n) of colors which can be displayed by the display which should output the image data and display colors.

Figure 14:
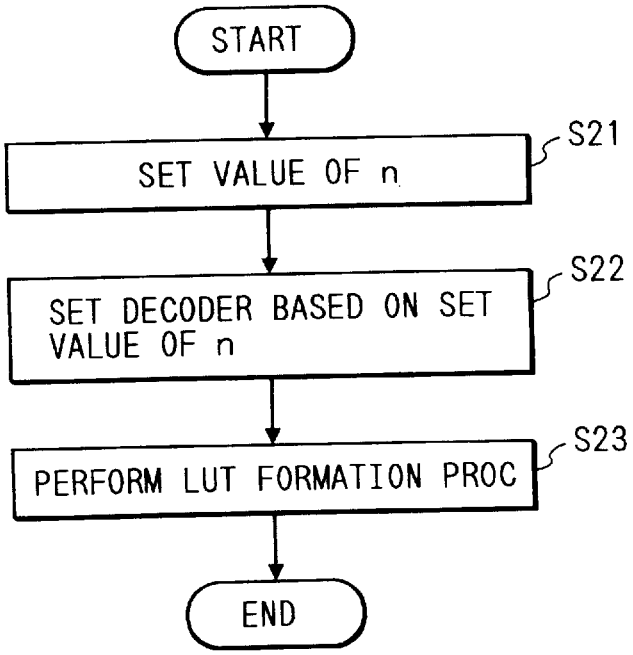
FIG. 14 is a flowchart for explaining an LUT generating process according to the tenth embodiment.

A generating process of the LUT 100 based on the frequency of the color of the input image and the number of colors which can be displayed by the display will now be described with reference to FIG. 14.

First, the number (n) of colors which can be displayed by the display which are designated by the user and the display colors are set (S21). As a setting method, it is possible to use a method whereby the negotiation is performed between the display device and the host, and the number (n) of colors which can be displayed by the display device and the display colors are confirmed and set or a method whereby the user can manually set the number (n) of colors and display colors according to the display.

Particularly, in case of confirming the number (n) of colors and display colors by the negotiation, a plurality of numbers of colors and a plurality of display colors are previously stored in correspondence to the kinds of display devices. The kind of display device is confirmed by the negotiation and the number of colors and the display colors corresponding to the confirmed kind are set.

The LUT 100 and decoder 105 are set in correspondence to the number (n) of colors and the display colors which were set in S21. That is, the frequencies of the colors of the input image can be detected in correspondence to n (S22).

On the basis of the set value of n and the frequencies of the colors which are counted by the counter 106, an LUT to reproduce the input image by n colors is generated by a process similar to the LUT generating process shown in FIG. 5.

According to the embodiment, the display interface can be made correspond to a plurality of display devices without holding the display I/F every display device.

<Tenth Embodiment >

Each of the above embodiments relates to the process for generating the LUT 100 on the basis of the number (n) of colors which can be displayed by the display device.

Figure 13:
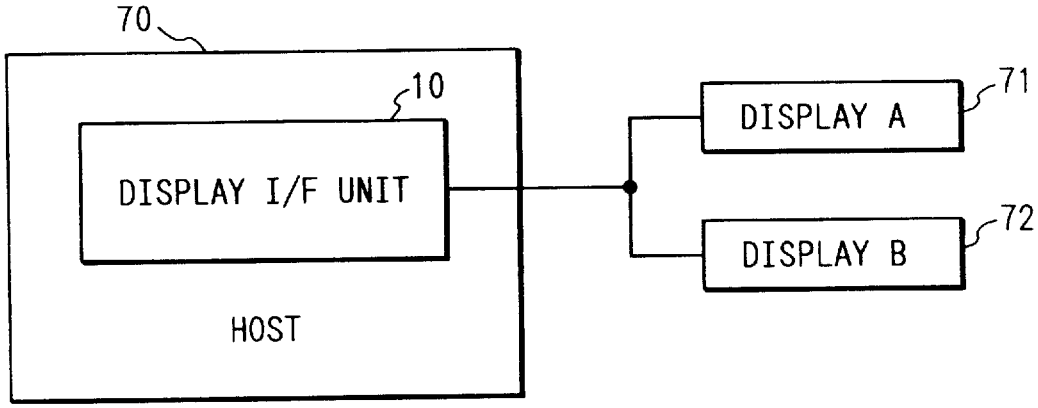
FIG. 13 is a diagram showing a construction of a system according to the ninth embodiment.

On the other hand, according to the tenth embodiment, the LUT 100 is generated on the basis of the number (h: $h \leq n$) of colors which was manually designated by the user every target image by using an operating device such as a mouse 34 or the like among the number (n) of colors which can be displayed by the display device. The system construction is similar to that in FIG. 1 or 13.

Figure 15A:
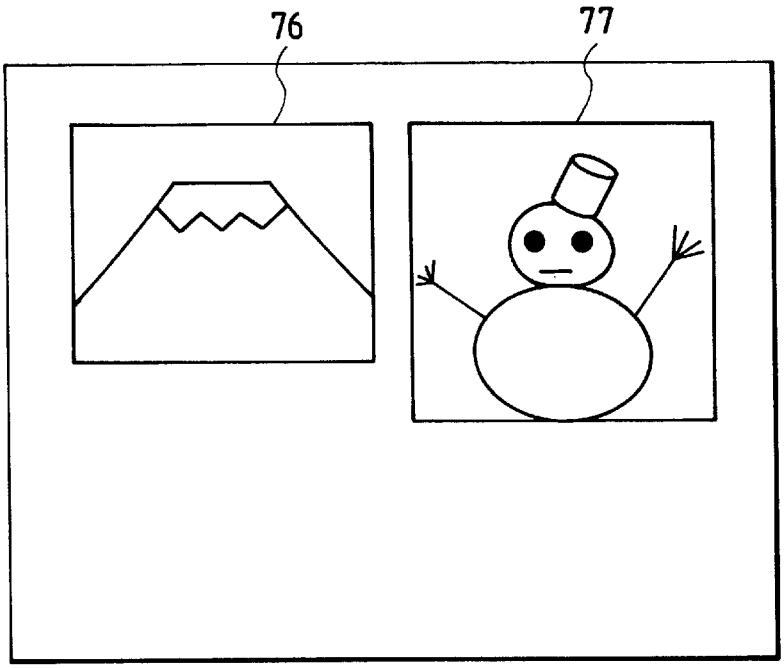
FIGS. 15A and 15B are diagrams showing examples of display screen in the tenth embodiment.
Figure 15B:
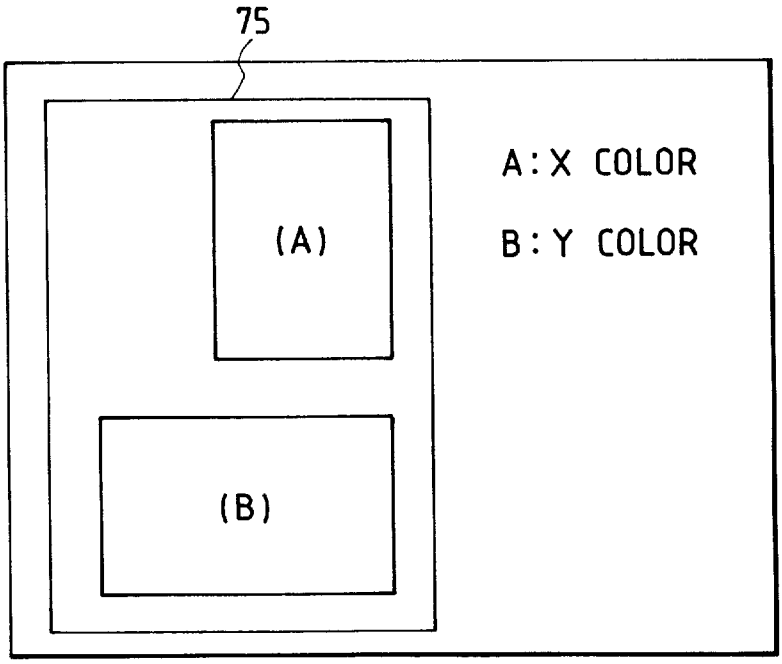

For example, as shown in FIG. 15B, there is a case where a plurality of objects A and B of different kinds of images are included in a certain image 75. For example, the number of colors of a natural image is generally very larger than that of a CG (computer graphics) showing a graph or the like.

Therefore, for the natural image (B), since it is an object to reconstruct the colors with a high fidelity, in order to preferably reconstruct the color gradation, the number of colors to be reconstructed is designated to the maximum number (h: h=n) of colors which can be displayed by the display device. On the other hand, in the case where the CG image (A) is a graph, since it is an object to clarify the color differences so as to enable the colors to be easily discriminated, the number (h: h<n) of colors included in the graph is designated.

As mentioned above, by reducing the number of colors to be reconstructed for the target image (object) in which a large number of colors are unnecessary, a data amount indicative of the image 75 can be reduced without deteriorating the reproducibility.

Rather than that, in case of outputting an image such as a graph or the like in which it is important to discriminate the colors, since a predetermined area can be reconstructed by only the same color without including different colors based on the above process, the reconstructed image of a better impression can be provided.

In case of displaying images 75 and 76 on the same picture plane as shown in FIG. 15A, since frequencies of the colors of the images 75 and 76 are different, an LUT suitable for each image can be also generated. The numbers of colors of the LUTs corresponding to those images can be also set to be equal.

It is sufficient for the user to manually select the display colors which are necessary when setting the LUT 100 and decoder 105 from among the colors which can be reconstructed by the display device in a manner similar to the number of colors. The display colors can be also automatically selected on the basis of the selected number of colors so as to be equivalently selected in the color space.

As mentioned above, the LUT generated based on the number of colors and the display colors which were set every target image is stored in correspondence to the target image. By switching the LUTs in accordance with the display address, the image is color processed by using the LUT suitable for each target image and is displayed.

According to the embodiment, even when a plurality of target images are included in the same picture plane, the LUT suitable for the color frequencies and/or the number of colors of each image can be generated.

The present invention is not limited to the foregoing embodiments but many modifications and variations are possible within the spirit and scope of the appended claims of the invention.

What is claimed is:

1. A color converting apparatus comprising:

converting means for converting color information by using a lookup table formed initially according to an input image;

measuring means for measuring occurrence frequency of output color data of the lookup table; and rewriting means for rewriting the lookup table based on a measured result from the measuring means such that dispersion of the measured occurrence frequency of each color is made smaller.

2. An apparatus according to claim 1, wherein the number of colors capable of being represented by the color information is larger than the number of colors of the output color data.

3. An apparatus according to claim 1, wherein said measuring means has a decoder for decoding said output color data and a counter, connected to each output of said decoder, for counting in accordance with each decoded output and decides the occurrence frequency on the basis of a count value of said counter.

4. An apparatus according to claim 1, further comprising display means for displaying an image based on the color information converted by using the rewritten lookup table.

5. A color converting apparatus for converting inputted color information by using a rewritable lookup table, comprising:

measuring means for measuring occurrence frequencies of output color data of said lookup table;

data obtaining means for obtaining table data which makes a dispersion of the occurrence frequencies of said output color data lie within a predetermined range on the basis of the occurrence frequency of each color which was measured by said measuring means; and writing means for writing said table data obtained by said data obtaining means into said lookup table, wherein said lookup table converts input colors into colors of a number smaller than the number of input colors and outputs, and wherein when the dispersion of the occurrence frequency of each color is equal to or larger than a predetermined value, said data obtaining means selects at least one of the color of a large occurrence frequency and the color of a small occurrence frequency and obtains table data such as to narrow an input width of said color of the large occurrence frequency and to widen an input width of said color of the small occurrence frequency.

6. A color converting method, comprising:

a converting step of converting color information by using a lookup table formed initially according to an input image;

a measuring step of measuring occurrence frequency of output color data of the lookup table; and a rewriting step of rewriting the lookup table based on a measured result from the measuring means such that dispersion of the measured occurrence frequency of each color is made smaller.

7. A method according to claim 6, wherein the number of colors capable of being represented by the color information is larger than the number of colors of the output color data.

8. A method according to claim 6, wherein said measuring step comprises the substeps of decoding the output color data and counting in accordance with each decoded output and deciding the occurrence frequency on the basis of a count value of the counting.

9. A display control apparatus for outputting a color image on the basis of color display data stored in a display memory, comprising:

reading means for reading out the color display data from said display memory;

palette means for inputting the color display data read out from said reading means and color converting; and output means for outputting the color display data which was color converted by said palette means, wherein said palette means has a rewritable lookup table for converting input colors, measuring means for measuring occurrence frequencies of output color data of said lookup table, data obtaining means for obtaining table data which makes a dispersion of the occurrence frequencies of said output color data lie within a predetermined range on the basis of the occurrence frequency of each color which was measured by said measuring means, and writing means for writing said table data obtained by said data obtaining means into said lookup table, wherein said lookup table converts input colors into colors of a number smaller than the number of input colors and outputs, and wherein when the dispersion of the occurrence frequency of each color is equal to or larger than a predetermined value, said data obtaining means selects at least one of the color of a large occurrence frequency and the color of a small occurrence frequency and obtains table data such as to narrow an input width of said color of the large occurrence frequency and to widen an input width of said color of the small occurrence frequency.

* * * * *

UNITED STATES PATENT AND TRADEMARK OFFICE

CERTIFICATE OF CORRECTION

PATENT NO. : 5,847,692 Page 1 of 2

DATED : December 8, 1998

INVENTOR(S) : Kenichiro Ono

It is certified that error appears in the above-identified patent and that said Letters Patent is hereby corrected as shown below:

COLUMN 1 line 14, "$m=2^6$" should read --m=6--.

COLUMN 3 line 32, "to" should read --with--.

COLUMN 5 line 17, "$2^m$ time or not." should read --$2^m$ times.--.

COLUMN 6 line 59, " ≅10.9The" should read -- ≅10.9. ¶ The--.

COLUMN 8 line 48, "red" should read --blue--.

UNITED STATES PATENT AND TRADEMARK OFFICE

CERTIFICATE OF CORRECTION

PATENT NO. : 5,847,692 Page 2 of 2

DATED : December 8, 1998

INVENTOR(S) : Kenichiro Ono

It is certified that error appears in the above-identified patent and that said Letters Patent is hereby corrected as shown below:

COLUMN 10 line 18, "on. Therefore," should read --on.
¶ Therefore,--; and line 32, "m=18and" should read --m=18 and--.

COLUMN 11 line 10, "correspond" should read --corresponding--.

Signed and Sealed this

Tenth Day of August, 1999

*Attest:*

Q. TODD DICKINSON

*Attesting Officer*

*Acting Commissioner of Patents and Trademarks*